US011547201B1

(12) United States Patent
Sun

(10) Patent No.: US 11,547,201 B1
(45) **Date of Patent: *Jan. 10, 2023**

(54) ROTARY HANGING CHAIR

(71) Applicant: Zhejiang Pride Leisure Products Co,. Ltd., Jinhua (CN)

(72) Inventor: Benlong Sun, Jinhua (CN)

(73) Assignee: Zhejiang Pride Leisure Products Co,. Ltd., Zhejiang Province (CN)

( * ) Notice: Subject to any disclaimer, the term of this patent is extended or adjusted under 35 U.S.C. 154(b) by 0 days.

This patent is subject to a terminal disclaimer.

(21) Appl. No.: 17/829,342

(22) Filed: May 31, 2022

Related U.S. Application Data

(63) Continuation-in-part of application No. 17/505,666, filed on Oct. 20, 2021, now Pat. No. 11,344,125.

(30) Foreign Application Priority Data

Jun. 1, 2021 (CN) ..... 202110610306.9
Nov. 8, 2021 (CN) ..... 202122727677.3

(51) Int. Cl.

| | |
|---|---|
| ***A45F 3/24*** | (2006.01) |
| ***A45F 3/26*** | (2006.01) |
| ***A47C 3/025*** | (2006.01) |
| ***A47C 3/18*** | (2006.01) |
| ***A63G 9/12*** | (2006.01) |

(Continued)

(52) U.S. Cl.
CPC ..... *A45F 3/26* (2013.01); *A45F 3/24* (2013.01); *A47C 3/0252* (2013.01); *A47C 3/0255* (2013.01); *A47C 3/18* (2013.01); *A63G 9/00* (2013.01); *A63G 9/04* (2013.01); *A63G 9/12* (2013.01); *A63G 27/02* (2013.01)

(58) Field of Classification Search
CPC ..... A47C 3/18; A47C 3/0255; A63G 9/00; A63G 9/04; A63G 9/12; A63G 27/02; A45F 3/24; A45F 3/26
USPC ..... 297/259.1, 273, 291, 344.1, 344.11, 297/344.21, 344.26; 472/118, 119
See application file for complete search history.

(56) References Cited

U.S. PATENT DOCUMENTS 679,963 A * 8/1901 Hayward ..... A45F 3/24 5/128
944,784 A * 12/1909 Hand ..... A45F 3/24 5/129

(Continued)

FOREIGN PATENT DOCUMENTS

CN 203028724 U * 7/2013

*Primary Examiner* — Robert Canfield
(74) *Attorney, Agent, or Firm* — WPAT Law, P.C.; Anthony King

(57) ABSTRACT

A rotary hanging chair comprises a cushion, a support frame and a base assembly. The cushion has two ends connected to an upper end of the support frame and is able to swing forwards and backwards with respect to the support frame. A bottom of the support frame is connected to the base assembly and is able to rotate within 360° with respect to the base assembly. The entire rotary hanging chair comprises three detachable parts, thus being simple and practical in structure, not only can swing forwards and backwards like a traditional hanging chair, but also can rotate within 360° to change the direction freely to meet the requirement for switching the view angle, and is small in size, easy to carry and capable of being used both indoors and outdoors.

18 Claims, 4 Drawing Sheets

(51) Int. Cl.

| | |
|---|---|
| ***A63G 27/02*** | (2006.01) |
| ***A63G 9/04*** | (2006.01) |
| ***A63G 9/00*** | (2006.01) |

(56) References Cited

U.S. PATENT DOCUMENTS

| | | | | | |
|---|---|---|---|---|---|
| 3,480,973 | A * | 12/1969 | Stairs | A47K 3/282 | 4/578.1 |
| 5,505,524 | A * | 4/1996 | Drumwright | A47C 7/004 | 297/183.5 |
| 6,748,616 | B1 * | 6/2004 | Tseng | A45F 3/24 | 5/120 |
| 7,380,880 | B2 * | 6/2008 | Molen | A47C 3/0255 | 5/120 |
| 10,912,375 | B1 * | 2/2021 | Demin | A45F 3/24 | |
| 2014/0306493 | A1 * | 10/2014 | Obolewicz | A47C 4/42 | 297/16.2 |
| 2015/0189994 | A1 * | 7/2015 | Lee | A47C 4/30 | 297/16.1 |
| 2020/0329873 | A1 * | 10/2020 | Sun | A47C 3/40 | |
| 2021/0112954 | A1 * | 4/2021 | Gibson | A45F 3/24 | |
| 2021/0145178 | A1 * | 5/2021 | Riley | A47C 1/03222 | |

* cited by examiner

ROTARY HANGING CHAIR

BACKGROUND OF THE INVENTION

1. Technical Field

The invention belongs to the technical field of chairs, and particularly relates to a rotary hanging chair.

2. Description of Related Art

Swing chairs are common leisure furniture in courtyards, gardens and amusement parks and are extremely popular in amusement parks because of their attractive appearance and romantic atmospheres created by them during use. When users sit on the swing chairs to rest in the shade, the swing chairs can by pushed to swing to allow users to feel comfortable and cool. Traditional swing chairs can only swing forwards and backwards like a swing and have a relatively constant angle that cannot be adjusted freely during use. In addition, existing swing chairs are provided with two symmetric supports, an adjustment device and a suspension rod are connected to the end of each support, and a shelter is assembled between the two adjustment devices. However, such swing chairs can only be used outdoors due to their large size. In addition, such swing chairs have a complicated structure, and it is difficult to assemble the ends of the supports, the adjustment devices, the suspension rods and the shelter together, which makes the swing chairs inconvenient to assemble and disassemble and makes it time-consuming and strenuous to assemble and dissemble such swing chairs. Besides, such swing chairs are inconvenient to use and difficult to carry. So, traditional changing chairs can only swing forwards and backwards, have a constant swing angle in use, and have a direction that cannot be adjusted, thus failing to meet the requirement of users for angle adjustment, and users cannot have a good relax when sitting on the swinging chairs.

BRIEF SUMMARY OF THE INVENTION

The objective of the invention is to overcome the above-mentioned defects by providing a rotary hanging chair, which not only can function as a traditional swing chair, but also can be rotated within 360° to change direction freely, is convenient to use, greatly improves user experience, and is small in size, easy to carry, and capable of being used both indoors and outdoors.

To fulfill the above objective, the invention adopts the following technical solution: a rotary hanging chair comprises a cushion, a support frame and a base assembly, wherein the cushion has two ends connected to an upper end of the support frame and is able to swing forwards and backwards with respect to the support frame, and a bottom of the support frame is connected to the base assembly and is able to rotate within 360° with respect to the base assembly. The rotary hanging chair is assembled merely through support tubes and a horizontal tube, so compared with traditional swing chairs with a complex structure, the rotary changing chair is lighter and simpler. The cushion of the rotary hanging chair is able to rotate with respect to leg tube assemblies, so users can rotate the cushion to change the direction of the cushion; and the cushion can also be swung like a swing, so users can feel more comfortable and have a good rest when sitting on the rotary hanging chair.

Further, the support frame comprises a body, a bearing and a connecting shaft, the bearing is disposed at a lower end of the body, and the connecting shaft in the middle of the bearing is connected to the base assembly. The bearing and the body are able to rotate in a circumferential direction with respect to the connecting shaft.

Even further, the body comprises two support tubes, two connecting members and a horizontal tube, each of two ends of the horizontal tube is provided with one connecting member, lower ends of the support tubes are detachably connected to the connecting members, and the two ends of the cushion are mounted at upper ends of the two support tubes; and the bearing is mounted in the middle of a bottom surface of the horizontal tube, and is rotatably connected to the base assembly through the connecting shaft.

Even further, the support frame further comprises cushion cloth locking plugs mounted at the upper ends of the support tubes, and each of the two ends of the cushion is fixed to one cushion block locking plug;

Even further, the support frame further comprises a protective cover, which is disposed above the horizontal tube and covers a joint of the horizontal tube and the bearing.

Further, the bearing is a tapered roller bearing that is able to steer under pressure.

The base assembly comprises a leg tube connecting seat, a support shaft and a plurality of leg tube assemblies, the support shaft is rotatably connected to a bottom surface of the support frame, and the leg tube assemblies are rotatably connected to the leg tube connecting seat disposed around an upper side of the support shaft.

Even further, each leg tube assembly comprises a leg tube and a connecting tube, wherein an upper end of the leg tube is rotatably connected to the leg tube connecting seat, two ends of the connecting tube are rotatably connected to a lower side of the support shaft and an outer wall of the leg tube respectively. Each leg tube assembly can be folded separately and can be pulled to the center to be stored.

Even further, each leg tube assembly further comprises a leg tube sleeve and a leg pad, wherein an upper end of the leg tube sleeve is disposed around a lower end of the leg tube, a spherical groove is formed in a lower end of the leg tube sleeve, and a ball on the leg pad is embedded in the spherical groove.

Even further, the base assembly further comprises a leg tube connecting seat decorative cover, which is disposed around the support shaft and covers the leg tube connecting seat.

Or, the base assembly comprises a support seat, a plurality of leg tubes and a plurality of leg pads, the plurality of leg tubes are annularly disposed on the support seat and are detachably connected to the support seat, and each leg tube has an end assembled on one leg pad.

Further, anti-skid lines are disposed on a bottom of the leg pads.

The invention has the following beneficial effects: the entire rotary hanging chair comprises three detachable parts, namely the cushion, the support frame and the base assembly, so the rotary hanging chair not only can swing forwards and backwards like a traditional hanging chair, but also can rotate within 360° to change the direction freely to meet the requirement for switching the view angle, and improve user experience; the base assembly adopt the foldable or datable leg tubes, and thus can be folded to be stored when transported or not used, and occupies less space; and the rotary hanging chair is simple in structure, low in weight, capable of being used easily and comfortably, convenient to assemble and disassemble, and capable of being used both indoors and outdoors easily and rapidly.

In the figures: 11, locking plug; 12, support tube; 13, connecting member; 14, horizontal tube; 15, protective cover; 16, leg tube connecting seat decorative cover; 17, cushion; 18, bearing; 19, leg tube connecting seat; 110, connecting shaft; 111, support shaft; 112, leg tube; 113, connecting tube; 114, leg tube sleeve; 1141, spherical groove; 115, leg pad; 116, tube sleeve; 21, fixing plug; 22, support tube; 23, connecting member; 24, horizontal tube; 25, protective cover; 26, leg tube; 27, leg pad; 28, bearing; 29, support seat; 210, connecting shaft; 211, support tube sleeve; 212, reinforcing rib; 213, anti-skid line; 214, bottom piece; 215, protective sleeve.

DETAILED DESCRIPTION OF THE INVENTION

To gain a better understanding of the technical solutions of the invention, the specific embodiments of specific solutions of the invention will be further expounded below in conjunction with the accompanying drawings.

Embodiment 1

Figure 1:
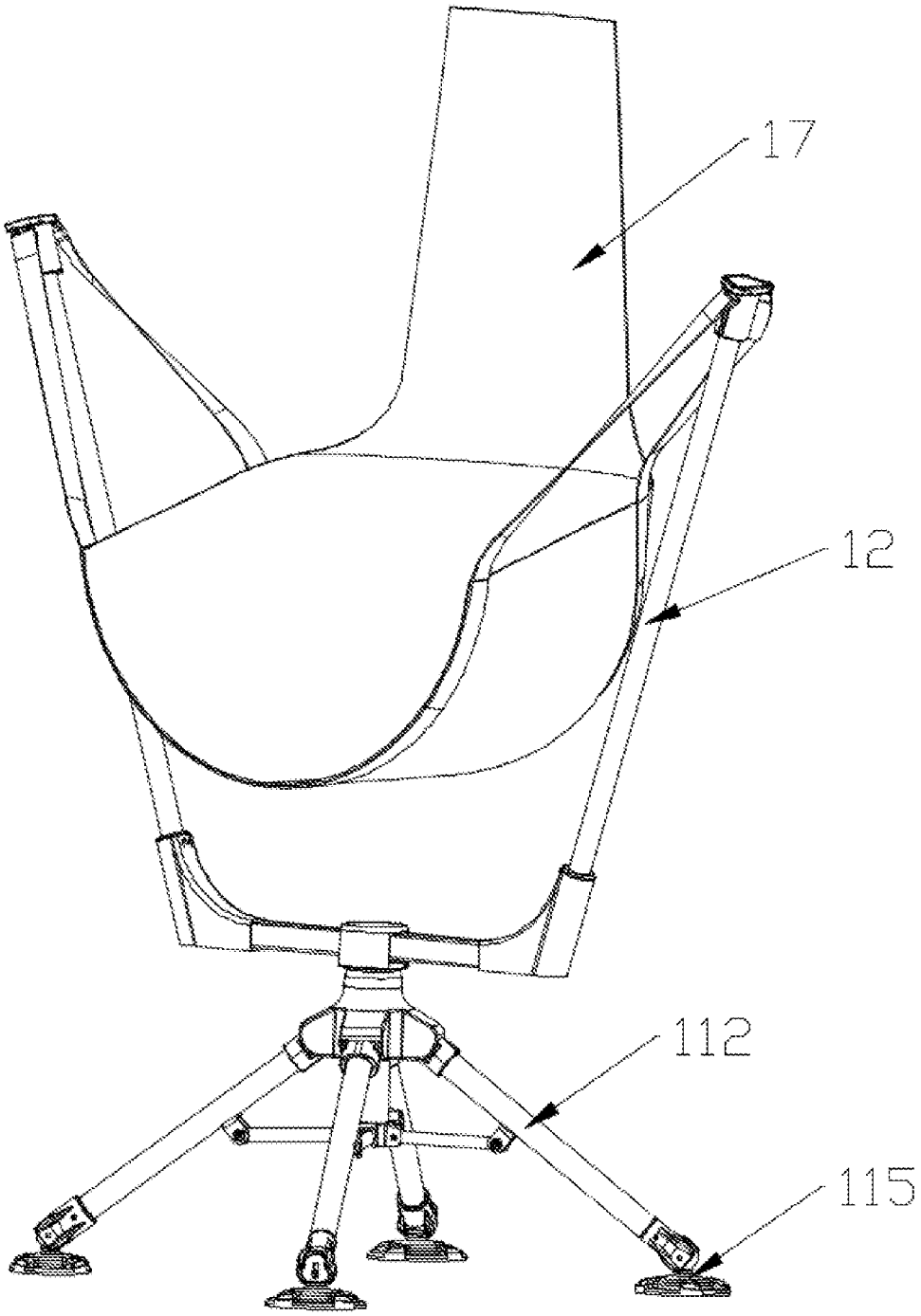
FIG. 1 is a three-dimensional view of a rotary hanging chair.
Figure 2:
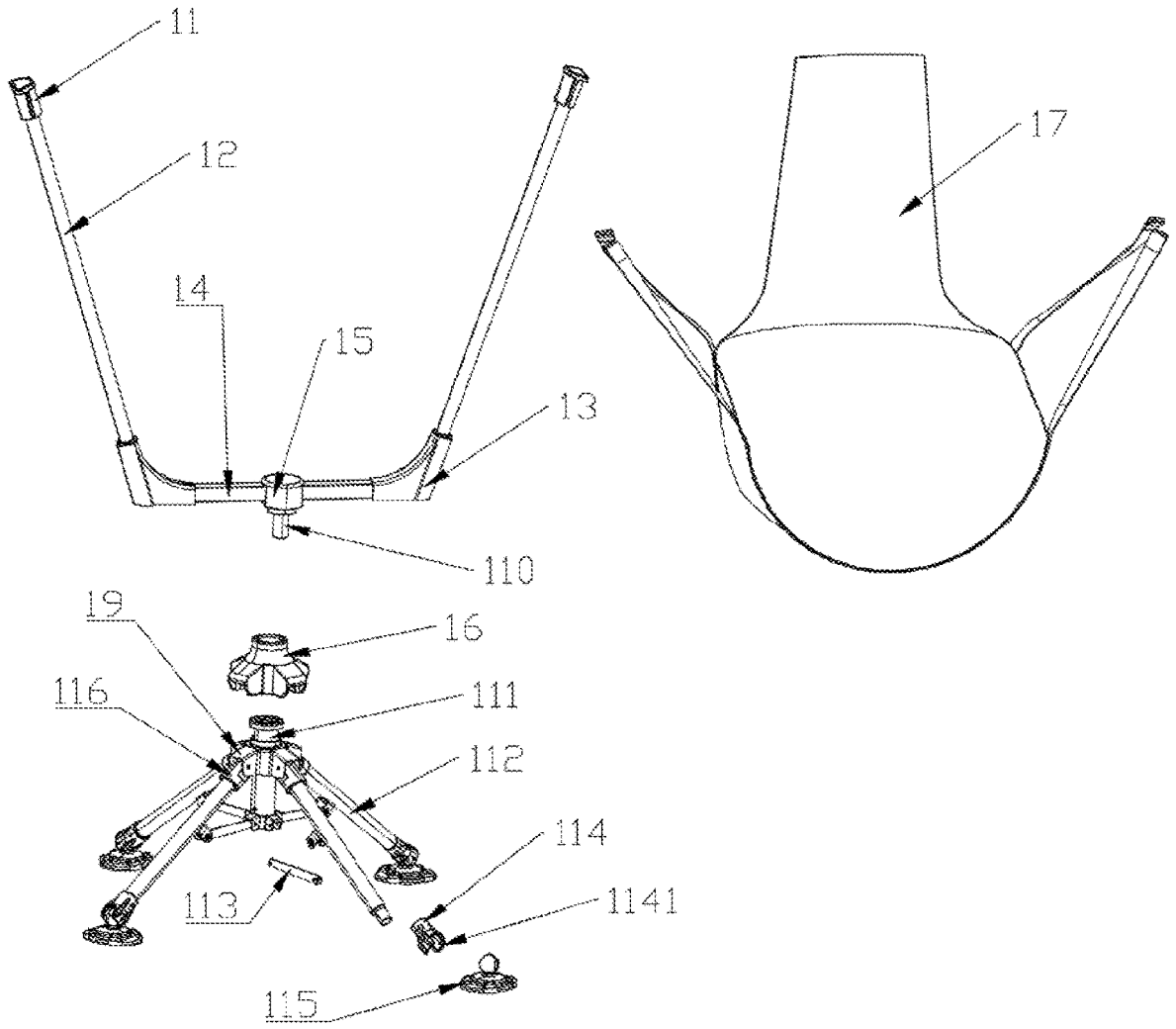
FIG. 2 is a disassembled view of a rotary hanging chair.
Figure 3:
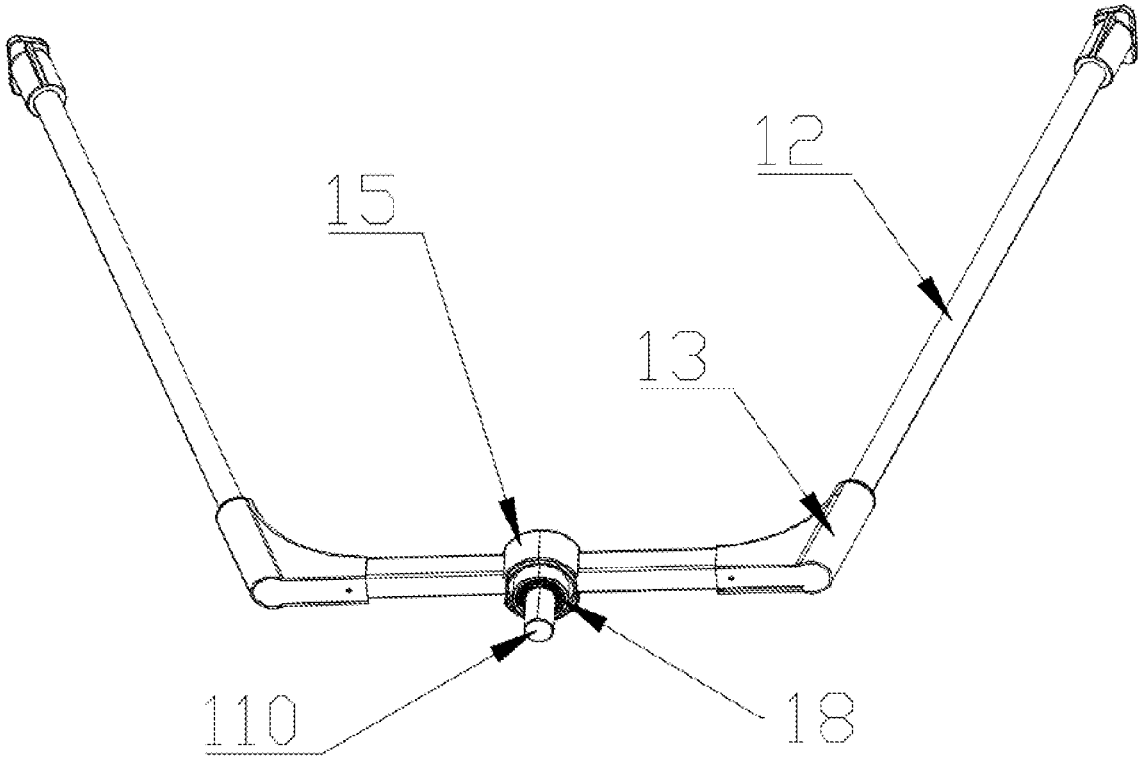
FIG. 3 is a schematic diagram of a support frame.

As shown in FIG. 1-FIG. 3, this embodiment discloses a rotary hanging chair, comprising a cushion 17, a support frame and a base assembly, wherein the support frame is detachably connected to the base assembly and is able to rotate within 360° in a circumferential direction with the base assembly as an axis, and the cushion 16 has left and right ends fixed to the support frame and is able to swing forwards and backwards with respect to the support frame. All components of the entire rotary hanging chair can be disassembled easily and can also be assembled conveniently and quickly.

Specifically, in this embodiment, the support frame comprises a body composed of two support tubes 12, two connecting members 13 and a horizontal tube 14, a bearing 18, a connecting shaft 110, a protective cover 15, and locking plugs 11. Wherein, each of two ends of the horizontal tube 14 is connected to a lower end of one support tube 12 through one connecting member 13, and upper ends of the two support tubes 12 are connected to two ends of the cushion 17; and the horizontal tube 14 is rotatably connected to a top of the base assembly, so that the entire support frame is able to rotate within 360° with respect to the base assembly.

For the purpose of rotation, the bearing 18 is disposed in the middle of a bottom surface of the horizontal tube 14, and the connecting shaft 110 in the middle of the bearing 18 is connected to the base assembly. Specifically, the connecting shaft is mounted on the base assembly, the entire support frame rotates with respect to the connecting shaft through the bearing, and then, the cushion 7 is driven to rotate by any angle.

In a preferred implementation, the connecting members 13 and the horizontal tube 14 are welded together, and the lower ends of the support tubes 12 are detachably connected to the connecting members 13. Slots are formed in upper ends of the connecting members 13, and the support tubes 12 are inserted into the slots, so that the horizontal tube 14 and the horizontal tubes 14 are assembled and fixed together, and the support tubes 12 and the horizontal tube 14 can be assembled and disassembled quickly. To improve the firmness of the structure, the horizontal tube 14 may be a square tube, and the support tubes 12 may be round tubes.

The locking plugs 11 are disposed around the upper ends of the support tubes 12, and suspension ropes at two ends of the cushion 17 are fixed to the locking plugs 11 on the two support tubes 2 respectively, so that the cushion 17 can swing forwards and backwards with respect to the support tubes 12 like a swing. The cushion 17 is designed with a backrest, so that users can feel more relaxed and comfortable when sitting on the rotary hanging chair. The two ends of the cushion are connected to an upper end of the support frame through adjustment belts, and the length of the adjustment belts is adjustable. By adjusting the length of the adjustment belts, different users can sit on the rotary hanging chair more comfortably.

The bearing is preferably a tapered roller bearing capable of steering under pressure, so that noise and shaking are smaller, and the stability is high.

In this embodiment, the protective cover 15 is disposed around the horizontal tube 14, clamping grooves are formed in two symmetrical ends of the protective cover 15, and the protective cover is clamped in the middle of the horizontal tube through the clamping grooves and covers a joint of the horizontal tube 14 and the bearing 4.

In a specific implementation, the base assembly comprises a leg tube connecting seat 19, a support shaft 111, a leg tube connecting seat decorative cover 16 and a plurality of leg tube assemblies. Each leg tube assembly comprises a leg tube 112, a connecting tube 113, a leg tube sleeve 114 and a leg pad 115.

The support shaft 111 is connected to the connecting shaft 110 of the support frame, and the connecting shaft 110 is inserted into the support shaft 111, so that the support frame is assembled on the base assembly. The leg tube assemblies are rotatably connected to the leg tube connecting seat 19 disposed around an upper side of the support shaft 111.

An upper end of the leg tube 112 is rotatably connected to the leg tube connecting seat 19, and two ends of the connecting tube 113 are rotatably connected to a lower side of the support shaft 111 and an outer wall of the leg tube 112 respectively. Four U-structures that are open downwards are symmetrically formed in the leg tube connecting seat 19. The upper end of the leg tube 12 is sleeved with a tube sleeve 116 that is able to rotate with respect to one U-structure through a hinge pin. Each U-structure that is open downwards is formed in a lower side of the support shaft 11 and is located in the outer wall of one leg tube 112, and the connecting tube 113 is assembled on the U-structure through the hinge pin, so that the connecting tube 13 is able to rotate.

When the rotary hanging chair is to be unfolded, the leg tubes 112 are pulled outwards and upwards to gradually form a tapered shape with the support shaft 111 as the center, the connecting tubes 113 are driven to be horizontal gradually until the base assembly is completely unfolded, the connecting shaft is inserted into the support shaft, and at this moment, users can sit on the rotary hanging chair. When the rotary hanging chair is to be folded, the leg tubes 112 are pushed inwards and downwards, the leg tubes 112 and the connecting tubes 113 move close to the axis of the support shaft 111 gradually, the multiple leg tubes 112 are gathered together to the center to fold the base assembly, and at this moment, the three-dimensional space occupied by the rotary hanging chair is reduced.

To ensure that the rotary hanging chair can be moved and stored conveniently, the leg pads 115 are designed into universal structures. Specifically, upper ends of the leg tube sleeves 114 are disposed around lower ends of the leg tubes 112 (preferably, the upper ends of the leg tube sleeves 114 are disposed around notches in the lower ends of the leg tubes 112), spherical grooves 1141 are formed in the lower ends of the leg tube sleeves 114, and balls on the leg pads 115 are embedded in the spherical grooves 1141. Through the spherical design, the leg pads can be flexibly adjusted to any angles.

Because the leg tube connecting seat 19, the support shaft 111 and the connecting shaft 110 are key parts that are assembled together, the leg tube connecting seat decorative cover 18 is disposed to cover the support shaft 111, so the support shaft 111 is prevented from being exposed, and the appearance is more beautiful and simpler.

To increase the support capacity on the ground, the leg pads 115 are in the shape of a disc, and the balls are disposed on the discs. The leg tubes 112 and the connecting tubes 113 are preferably round tubes.

Embodiment 2

Figure 4:
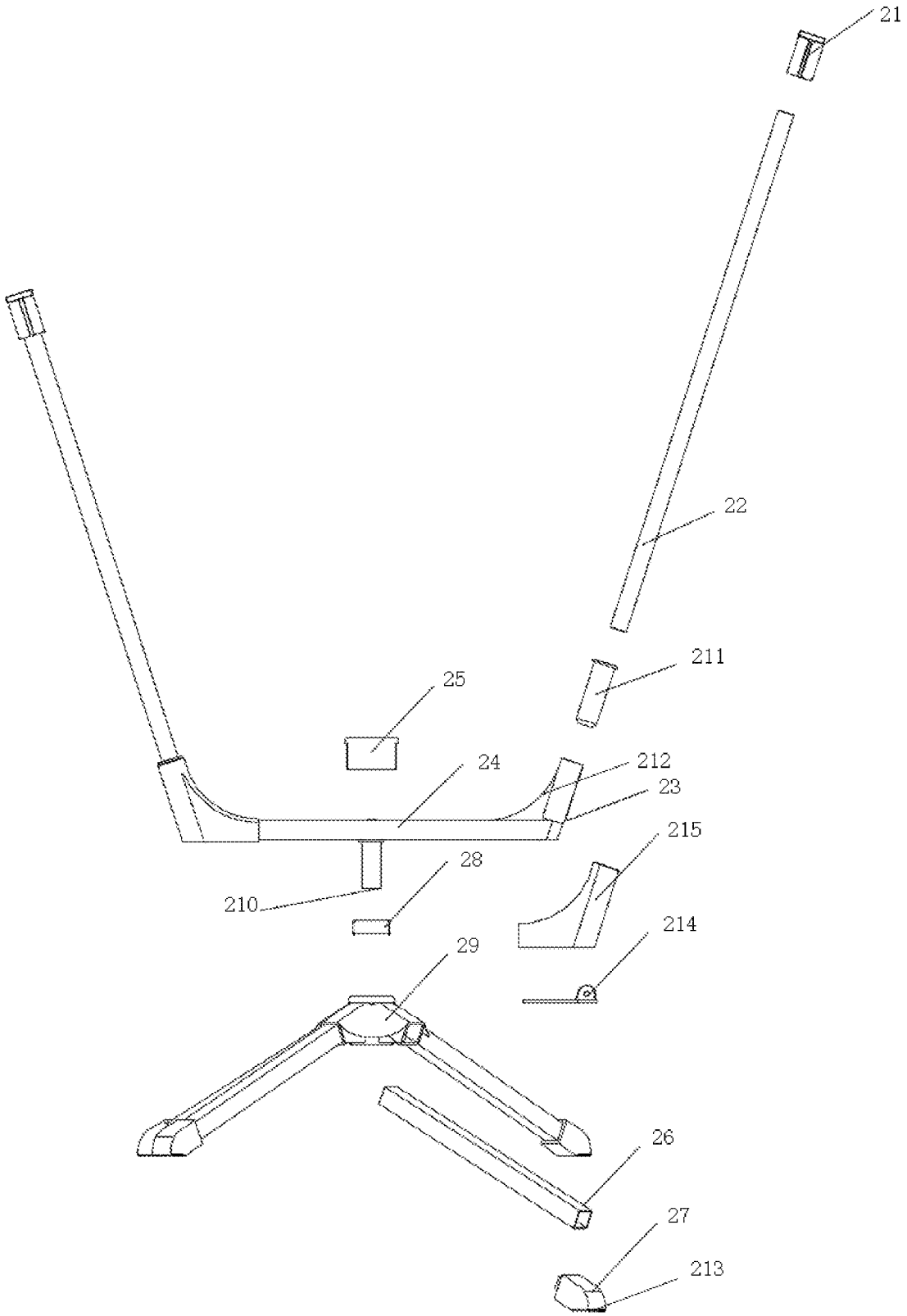
FIG. 4 is a disassembled view of a rotary hanging chair.

As shown in FIG. 4, this embodiment discloses a rotary hanging chair, comprising a cushion (not shown), a support frame and a base assembly, wherein the cushion and the support frame are mounted above the base assembly, and the support frame is detachably connected to the base assembly. All components of the entire rotary hanging chair can be disassembled easily and can also be assembled conveniently and quickly. Two ends of the cushion are connected to an upper end of the support frame through adjustment belts, and the length of the adjustment belts is adjustable. By adjusting the length of the adjustment belts, different users can sit on the rotary hanging chair more comfortably.

Specifically, in this embodiment, the support frame comprises two support tubes 22, two connecting members 23, a horizontal tube 24, a protective cover 25, a bearing 28, and a connecting shaft 210 disposed in the middle of a bottom surface of the horizontal tube, wherein each of two ends of the horizontal tube 24 is connected to a lower end of one support tube 22 through one connecting member 23, and upper ends of the two support tubes 22 are connected to two ends of the cushion; the horizontal tube 24 is rotatably connected to a top of the base assembly, the middle of the horizontal tube 24 is welded to the connecting shaft 210, the bearing 28 is assembled on the connecting shaft 210, and the connecting shaft 210 is mounted on the base assembly. Through the rotation of the bearing 28 and the connecting shaft 210, the entire support frame can rotate within 360° with respect to the base assembly. The protective cover 25 is mounted over the horizontal tube 24 and corresponds to the bearing in position.

In a preferred implementation, the connecting members 23 and the horizontal tube 24 are welded together. Assembly holes are formed in upper ends of the connecting members, and the support tubes 22 are inserted into the assembly holes, so that the horizontal tube and the support tubes are assembled and fixed together. The horizontal tube 24 may be a square tube, and the support tubes 22 may be round tubes. To improve the firmness of the structure, support tube sleeves 211 are disposed at lower ends of the support tubes, and a protective sleeve 215 is assembled outside each connecting member 23, and bottom pieces 214 fixed to the horizontal tube 24 are disposed at the bottom of the protective sleeves.

Reinforcing ribs 212 connected to the horizontal tube 24 are disposed on inner sides of the connecting members 23, so that the strength of the structure is improved, and the durability is improved. The connecting members 23, the horizontal tube 24 and the reinforcing ribs 212 are fixed into a whole by welding.

In this embodiment, the support frame further comprises cushion cloth locking plugs 21, and the cushion cloth locking plugs 21 are mounted at upper ends of the support tubes 22. Specifically, the cushion cloth locking plugs 21 are disposed around the upper ends of the support tubes 22, and each of the two ends of the cushion is fixed to one cushion cloth locking plug 1, so that the cushion is able to swing forwards and backwards like a swing with respect to the support tubes.

In a preferred implementation, the base assembly comprises a support seat 29, multiple leg tubes 26 and multiple leg pads 27. Wherein, the bearing 28 is mounted at an upper end of the support seat 29 through the connecting shaft 210, the middle of the horizontal tube 24 is welded to the connecting shaft 210, and the connecting shaft 210 is assembled on the bearing 28, so that the support frame is rotatably connected to the support seat 29. One end of each leg tube 26 is detachably connected to the support seat 29, and the other end of each leg tube 26 is assembled on one leg pad 27. The leg tubes 26 may be square tubes.

The bearing 28 is preferably a tapered roller bearing capable of steering under pressure, so that noise and shaking are smaller, and the stability is high.

Specifically, a plurality of symmetrical leg tube connecting portions are annularly disposed on the support seat 29, each leg tube connecting portion is provided with a hollow slot, upper ends of the leg tubes 26 are inserted into the slots to be detachably assembled on the leg tube connecting portions, and the leg pads 27 are disposed around lower ends of the leg tubes 26.

To increase the friction with the ground to prevent the chair from sliding when rotated or swung like a swing, anti-skid lines 213 are disposed at the bottom of the leg pads 27.

It should be noted that the aforesaid description is merely used to explain the preferred embodiments and technical principle of the invention. Those skilled in the art would appreciate that the invention is not limited to the specific embodiments described here, and various obvious transformations, adjustments and substitutions can be made by those skilled in the art without departing from the protection scope of the invention. So, although the invention has been described in detail with reference to the above embodiments, the invention is not limited to these embodiments and may include more other equivalent embodiments without departing from the concept of the invention, and the scope of the invention is subject to the scope of the claims.

What is claimed is:

1. A rotary hanging chair, comprising a cushion, a support frame and a base assembly, wherein the cushion has two ends connected to an upper end of the support frame and is able to swing forwards and backwards with respect to the support frame, and a bottom of the support frame is connected to the base assembly and is able to rotate within 360° with respect to the base assembly; and wherein the support frame comprises a body, a bearing and a connecting shaft, the bearing is disposed at a lower end of the body, and the connecting shaft in a middle of the bearing is connected to the base assembly;

wherein the body comprises two support tubes, two connecting members and a horizontal tube, each of two ends of the horizontal tube is provided with one said connecting member, lower ends of the support tubes are detachably connected to the connecting members, and the two ends of the cushion are mounted at upper ends of the two support tubes; and the bearing is mounted in a middle of a bottom surface of the horizontal tube, and is rotatably connected to the base assembly through the connecting shaft.

2. The rotary hanging chair according to claim 1, wherein the connecting members are fixedly connected to the horizontal tube, slots are formed in upper ends of the connecting members, and the lower ends of the support tubes are embedded in the slots.

3. The rotary hanging chair according to claim 2, wherein the base assembly comprises a leg tube connecting seat, a leg tube connecting seat decorative cover, a support shaft and a plurality of leg tube assemblies, the support shaft is rotatably connected to a bottom surface of the support frame, the leg tube assemblies are rotatably connected to the leg tube connecting seat disposed around an upper side of the support shaft, and the leg tube connecting seat decorative cover is disposed around the support shaft and covers the leg tube connecting seat.

4. The rotary hanging chair according to claim 3, wherein each said leg tube assembly comprises a leg tube, a connecting tube, a leg tube sleeve and a leg pad, an upper end of the leg tube is rotatably connected to the leg tube connecting seat, two ends of the connecting tube are rotatably connected to a lower side of the support shaft and an outer wall of the leg tube respectively, an upper end of the leg tube is disposed around a lower end of the leg tube, a spherical groove is formed in a lower end of the leg tube sleeve, and a ball on the leg pad is embedded in the spherical groove.

5. The rotary hanging chair according to claim 2, wherein the base assembly comprises a support seat, a plurality of leg tubes and a plurality of leg pads, the plurality of leg tubes are annularly disposed on the support seat and are detachably connected to the support seat, and each said leg tube has an end assembled on one said leg pad.

6. The rotary hanging chair according to claim 1, wherein the support frame further comprises cushion cloth locking plugs mounted at the upper ends of the support tubes, and each of the two ends of the cushion is fixed to one said cushion block locking plug;

or, the support frame further comprises a protective cover, which is disposed above the horizontal tube and covers a joint of the horizontal tube and the bearing.

7. The rotary hanging chair according to claim 6, wherein the base assembly comprises a support seat, a plurality of leg tubes and a plurality of leg pads, the plurality of leg tubes are annularly disposed on the support seat and are detachably connected to the support seat, and each said leg tube has an end assembled on one said leg pad.

8. The rotary hanging chair according to claim 1, wherein the bearing is a tapered roller bearing that is able to steer under pressure;

or, the two ends of the cushion are connected to the upper end of the support frame through adjustment belts, and a length of the adjustment belt is adjustable.

9. The rotary hanging chair according to claim 8, wherein the base assembly comprises a support seat, a plurality of leg tubes and a plurality of leg pads, the plurality of leg tubes are annularly disposed on the support seat and are detachably connected to the support seat, and each said leg tube has an end assembled on one said leg pad.

10. The rotary hanging chair according to claim 1, wherein the base assembly comprises a leg tube connecting seat, a leg tube connecting seat decorative cover, a support shaft and a plurality of leg tube assemblies, the support shaft is rotatably connected to a bottom surface of the support frame, the leg tube assemblies are rotatably connected to the leg tube connecting seat disposed around an upper side of the support shaft, and the leg tube connecting seat decorative cover is disposed around the support shaft and covers the leg tube connecting seat.

11. The rotary hanging chair according to claim 10, wherein each said leg tube assembly comprises a leg tube, a connecting tube, a leg tube sleeve and a leg pad, an upper end of the leg tube is rotatably connected to the leg tube connecting seat, two ends of the connecting tube are rotatably connected to a lower side of the support shaft and an outer wall of the leg tube respectively, an upper end of the leg tube is disposed around a lower end of the leg tube, a spherical groove is formed in a lower end of the leg tube sleeve, and a ball on the leg pad is embedded in the spherical groove.

12. The rotary hanging chair according to claim 1, wherein the base assembly comprises a leg tube connecting seat, a leg tube connecting seat decorative cover, a support shaft and a plurality of leg tube assemblies, the support shaft is rotatably connected to a bottom surface of the support frame, the leg tube assemblies are rotatably connected to the leg tube connecting seat disposed around an upper side of the support shaft, and the leg tube connecting seat decorative cover is disposed around the support shaft and covers the leg tube connecting seat.

13. The rotary hanging chair according to claim 12, wherein each said leg tube assembly comprises a leg tube, a connecting tube, a leg tube sleeve and a leg pad, an upper end of the leg tube is rotatably connected to the leg tube connecting seat, two ends of the connecting tube are rotatably connected to a lower side of the support shaft and an outer wall of the leg tube respectively, an upper end of the leg tube is disposed around a lower end of the leg tube, a spherical groove is formed in a lower end of the leg tube sleeve, and a ball on the leg pad is embedded in the spherical groove.

14. The rotary hanging chair according to claim 12, wherein anti-skid lines are disposed on a bottom of the leg pads.

15. The rotary hanging chair according to claim 1, wherein the base assembly comprises a support seat, a plurality of leg tubes and a plurality of leg pads, the plurality of leg tubes are annularly disposed on the support seat and are detachably connected to the support seat, and each said leg tube has an end assembled on one said leg pad.

16. The rotary hanging chair according to claim 1, wherein the base assembly comprises a support seat, a plurality of leg tubes and a plurality of leg pads, the plurality of leg tubes are annularly disposed on the support seat and are detachably connected to the support seat, and each said leg tube has an end assembled on one said leg pad.

17. A rotary hanging chair, comprising a cushion, a support frame and a base assembly, wherein the cushion has two ends connected to an upper end of the support frame and is able to swing forwards and backwards with respect to the support frame, and a bottom of the support frame is connected to the base assembly and is able to rotate within 360° with respect to the base assembly, wherein the base assembly comprises a leg tube connecting seat, a leg tube connecting seat decorative cover, a support shaft and a plurality of leg tube assemblies, the support shaft is rotatably connected to a bottom surface of the support frame, the leg tube assemblies are rotatably connected to the leg tube connecting seat disposed around an upper side of the support shaft, and the leg tube connecting seat decorative cover is disposed around the support shaft and covers the leg tube connecting seat.

18. The rotary hanging chair according to claim 17, wherein each said leg tube assembly comprises a leg tube, a connecting tube, a leg tube sleeve and a leg pad, an upper end of the leg tube is rotatably connected to the leg tube connecting seat, two ends of the connecting tube are rotatably connected to a lower side of the support shaft and an outer wall of the leg tube respectively, an upper end of the leg tube is disposed around a lower end of the leg tube, a spherical groove is formed in a lower end of the leg tube sleeve, and a ball on the leg pad is embedded in the spherical groove.

* * * * *